US008807124B2

(12) United States Patent
Tanaya

(10) Patent No.: US 8,807,124 B2
(45) Date of Patent: Aug. 19, 2014

(54) IGNITION APPARATUS

(75) Inventor: Kimihiko Tanaya, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 163 days.

(21) Appl. No.: 13/414,802

(22) Filed: Mar. 8, 2012

(65) Prior Publication Data

US 2013/0093342 A1 Apr. 18, 2013

(30) Foreign Application Priority Data

Oct. 17, 2011 (JP) ..... 2011-227645

(51) Int. Cl.
*F02P 3/09* (2006.01)

(52) U.S. Cl.
USPC ..... 123/605; 123/606; 123/608; 315/209 R; 315/209 CD; 315/224; 315/291; 313/118

(58) Field of Classification Search
USPC ..... 315/209 R, 209 CD, 224, 291, 307, 308; 313/118; 123/605, 606, 608
See application file for complete search history.

(56) References Cited

U.S. PATENT DOCUMENTS 4,733,646 A * 3/1988 Iwasaki ..... 123/597
6,476,568 B2 * 11/2002 Urakabe et al. ..... 315/307

FOREIGN PATENT DOCUMENTS

| | | | |
|---|---|---|---|
| JP | 49-28720 | A2 | 3/1974 |
| JP | 52-104634 | | 9/1977 |
| JP | 63-036062 | A | 2/1988 |
| JP | 2006-063973 | A | 3/2006 |
| JP | 2010-096128 | A | 4/2010 |
| JP | 4497027 | B2 | 7/2010 |

OTHER PUBLICATIONS

Japanese Office Action, dated Oct. 16, 2012, issued in corresponding Japanese Application No. 2011-227645.

* cited by examiner

*Primary Examiner* — Douglas W Owens
*Assistant Examiner* — Thai Pham
(74) *Attorney, Agent, or Firm* — Sughrue Mion, PLLC

(57) ABSTRACT

When the first switch is on, the ignition capacitor is charged up to a voltage value whose absolute value is larger than an output voltage value of a DC power source, through resonance caused by a resonance coil and the ignition capacitor; when the second switch is on, the ignition capacitor supplies energy to the ignition coil device, and when the second switch is off, the energy is released and a high voltage is applied across electrodes of an ignition plug.

7 Claims, 3 Drawing Sheets

IGNITION APPARATUS

BACKGROUND OF THE INVENTION

1. Field of the Invention

The present invention relates to an ignition apparatus for controlling ignition of an internal combustion engine mainly utilized in a vehicle.

2. Description of the Related Art

In recent years, the issues such as environment preservation and inflammable fuel-air mixture depletion have been raised; measures for these issues are urgently required also in the automobile industry. The measures include, as an example, ultra-lean-combustion (sometimes referred to as stratified-lean-combustion) operation of an internal combustion engine that utilizes a stratified air-fuel mixture. However, in the stratified lean combustion, the distribution of inflammable fuel-air mixtures may vary; therefore, an ignition apparatus capable of absorbing this variation is required. Accordingly, in order to reduce the variation in the distribution of inflammable fuel-air mixtures in the stratified lean combustion, ignition apparatuses disclosed in Patent Documents 1 and 2 have been proposed.

In an ignition apparatus disclosed in Patent Document 1, by use of a capacitive discharging method, a dielectric breakdown is produced between the electrodes of an ignition plug, and after the dielectric breakdown between the electrodes through the capacitive discharging method, an AC spark discharge is continuously produced between the electrodes of the ignition plug through an inductive discharging method. The inductive discharging method is a discharging method in which energy is continually supplied from a coil in which the energy is preliminarily accumulated to the primary coil of an ignition coil device so that an AC spark discharge is continuously produced between the electrodes of an ignition plug. It is alleged that because the conventional ignition apparatus configured in such a manner makes it possible to continue a spark discharge for a long period, a great number of temporal igniting opportunities can be provided and hence the variation in the distribution of inflammable fuel-air mixtures can be absorbed.

A conventional ignition apparatus disclosed in Patent Document 2 is provided with an ignition plug that produces a spark discharge in a combustion chamber and a microwave generation apparatus that supplies energy to the spark discharge produced in the ignition plug. It is alleged that because the conventional ignition apparatus makes it possible to form larger discharge plasma, a great number of spatial igniting opportunities can be provided and hence the variation in the distribution of inflammable fuel-air mixtures can be absorbed.

PRIOR ART REFERENCE

Patent Document

[Patent Document 1] Japanese Patent No. 4497027

[Patent Document 2] Japanese Patent Application Laid-Open No. 2010-96128

In the conventional ignition apparatus disclosed in Patent Document 1, it is true that by realizing a long term discharge, temporal igniting opportunities increase and hence an effect is demonstrated in terms of extinction prevention; however, the variation in igniting timings cannot be suppressed, whereby there remains problems in terms of improvement of the output, improvement of the variation in the torque to be produced, improvement of the drivability, and the like. In order to solve these problems, it is required to further increase the spatial igniting opportunities. Although the conventional ignition apparatus disclosed in Patent Document 1 can make the discharge plasma larger because it performs an AC discharge, it takes a considerable time to accumulate energy in an energy accumulation coil; therefore, it is difficult to perform a sort-time AC discharge, and in order to supply large energy, it is required to drastically enlarge the size of the energy accumulation coil; thus, there is posed, for example, a problem that heat generation increases.

In contrast, the conventional ignition apparatus disclosed in Patent Document 2 can prevent extinction and can suppress the variation in the torque to be produced because it can form large discharge plasma; however, because a path for introducing a microwave is required in addition to an ignition plug, it is difficult to apply the ignition apparatus disclosed in Patent Document 2 to an existing internal combustion engine. Because a piston reciprocates and hence a large pressure change is recurrently caused and because plasma produced through discharge and combustion alternately repeats generation and extinction, the inside of an internal combustion engine is extremely unstable; thus, in terms of impedance matching, it is technically difficult and in terms of matching between individual products, it is extremely difficult to stably supply high-frequency energy such as a microwave to the unstable combustion chamber of the internal combustion engine.

SUMMARY OF THE INVENTION

The present invention has been implemented in order to solve the foregoing problems in conventional ignition apparatuses; the objective thereof is to provide an ignition apparatus that can stably produce stratified lean combustion or the like of an inflammable fuel-air mixture.

An ignition apparatus according to the present invention is provided with an ignition plug that is provided with a pair of electrodes that face each other through a gap and that produces a spark discharge in the gap when a predetermined high voltage is applied across the pair of electrodes so that an inflammable fuel-air mixture inside a combustion chamber of an internal combustion engine is ignited; an ignition coil device that generates the predetermined high voltage, by accumulating energy and releasing the accumulated energy, and that applies the generated predetermined high voltage across the electrodes; an energy supply device that is provided with an ignition capacitor to be charged through a resonance coil by a DC power source and a first switch connected between the ignition capacitor and a ground potential, and that can supply the energy to the ignition coil device from the ignition capacitor; a second switch connected between the ignition coil device and the energy supply device; and a control device that outputs a first control signal for controlling switching operation by the first switch and a second control signal for controlling switching operation by the second switch. The ignition apparatus is characterized in that the first control signal controls a time instant when the first switch is turned from off to on and a time during which the first switch is kept on; the second control signal controls a time instant when the second switch is turned from off to on and a time during which the second switch is kept on; the first control signal and the second control signal control respective switching operations of the corresponding switches in such a way that when the first switch is on, the second switch becomes off, and when the first switch is off, the second switch becomes on; when the first switch is on, the energy supply device charges the ignition capacitor to a voltage value whose absolute value is larger than an output voltage value of the DC power source, through resonance caused by the resonance coil and the ignition capacitor; and when the second switch is on, the ignition coil device receives the energy from the charged ignition capacitor and accumulates the energy, and when the second switch is off, the ignition coil device releases the accumulated energy so as to generate the high voltage.

An ignition apparatus according to the present invention makes it possible to supply an AC discharge current across electrodes of an ignition plug in a short cycle; therefore, it is made possible that discharge plasma is simply and readily formed and combustion such as stratified lean combustion is stably produced. As a result, because an inflammable fuel-air mixture utilized for the operation of an internal combustion engine can drastically be reduced, the carbon footprint can largely be decreased, whereby the ignition apparatus according to the present invention can contribute to the environment preservation.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
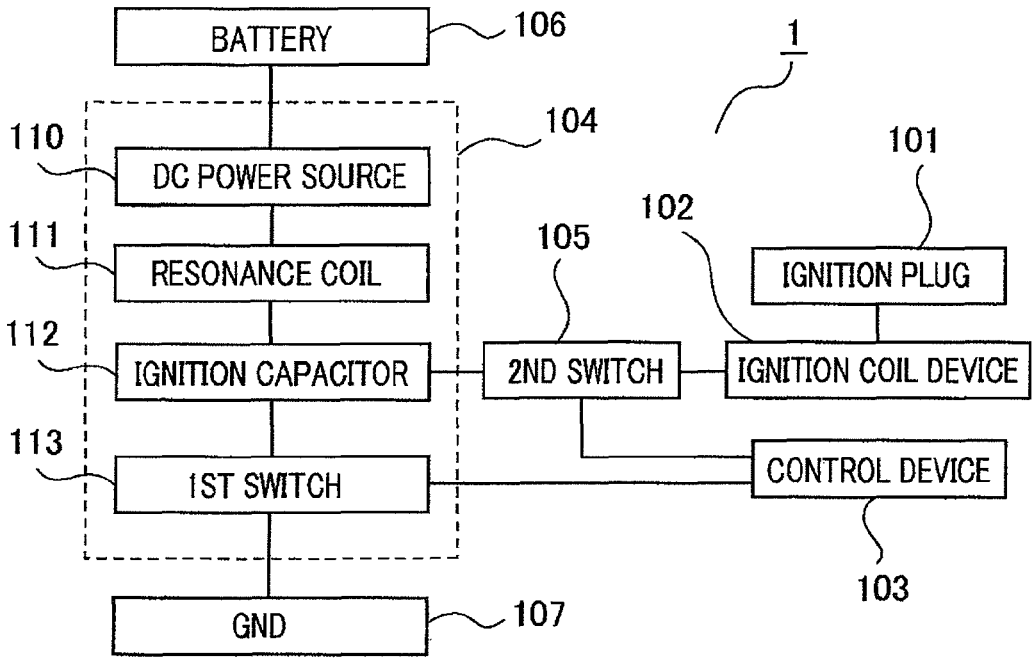
FIG. 1 is a block diagram of an ignition apparatus according to Embodiment 1 of the present invention.

Hereinafter, an ignition apparatus according to Embodiment of the present invention will be explained in detail with reference to the drawings. FIG. 1 is a block diagram of an ignition apparatus according to Embodiment 1 of the present invention. In FIG. 1, an ignition apparatus 1 of an internal combustion engine (unillustrated) mounted in a vehicle or the like is configured with an ignition plug 101, an ignition coil device 102, an energy supply device 104, and a control device 103. Reference numeral 107 denotes a GND-level portion (referred to as GND, hereinafter) of the internal combustion engine.

The energy supply device 104 is configured with a DC power source 110 that boosts and stores the output voltage of a battery 106, a resonance coil 111 that further boosts the output voltage of the DC power source 110, an ignition capacitor 112 that is charged based on the voltage boosted by the resonance coil 111, and a first switch 113 that is controlled by the control device 103 and controls the charging timing for the ignition capacitor 112.

The ignition plug 101 is mounted in the internal combustion engine (unillustrated) and produces discharge plasma for igniting an inflammable fuel-air mixture supplied to the inside of a combustion chamber of the internal combustion engine. The ignition coil device 102 supplies the ignition plug with a voltage and a current, which are energy for producing discharge plasma between a pair of electrodes of the ignition plug 101.

Based on the output of the battery 106 mounted in a vehicle, the energy supply device 104 produces energy that is required for producing energy to be supplied to the ignition plug 101 by the ignition coil device 102. In response to a control signal from the control device 103, a second switch 105 controls energy supply from the energy supply device 104 to the ignition coil device 102.

Figure 2:
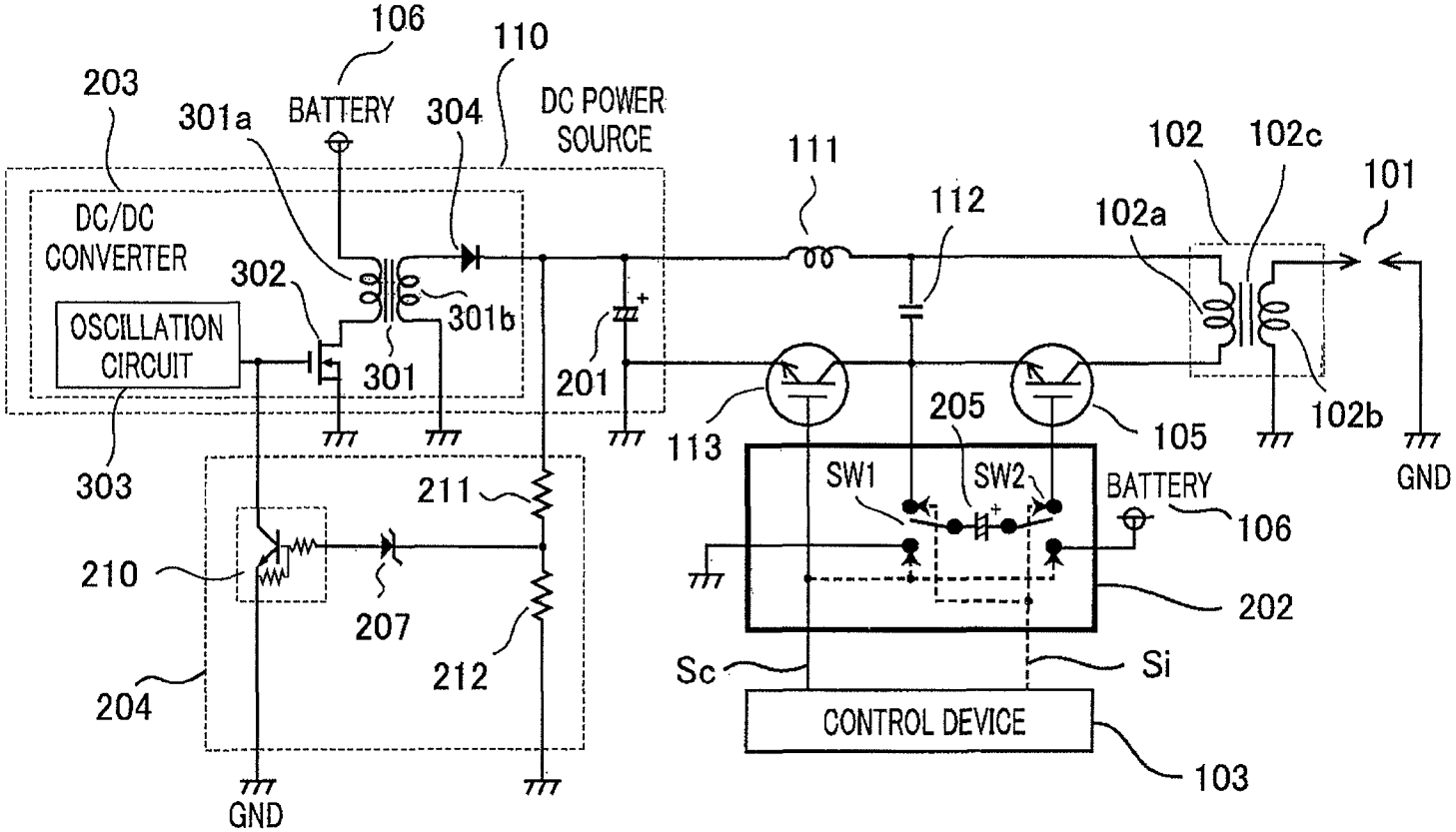
FIG. 2 is a circuit configuration diagram of an ignition apparatus according to Embodiment 1 of the present invention.

Next, there will be explained the specific configuration of the ignition apparatus 1 according to Embodiment 1 of the present invention. FIG. 2 is a circuit configuration diagram of an ignition apparatus according to Embodiment 1 of the present invention; the constituent elements corresponding to those in FIG. 1 are designated by the same reference characters. In FIG. 2, the DC power source 110 is configured with a DC/DC converter 203 and a tank capacitor 201 that is charged with the output of the DC/DC converter 203.

The DC/DC converter 203 is provided with a voltage boosting transformer 301 configured with a primary coil 301*a* connected with the output terminal of the battery 106 and a secondary coil 301*b* magnetically coupled with the primary coil 301*a*, a switching device 302 connected in series with the primary coil 301*a* of the voltage boosting transformer 301, a oscillation circuit 303 that supplies a voltage oscillating at a predetermined frequency to the base of the switching device 302, and a diode 304 that rectifies the output of the secondary coil 301*b* of the voltage boosting transformer 301. It is desirable that the DC/DC converter 203 is configured in such a way as to have an ability of generating the output of approximately 30 [W] or larger so that it can rapidly charge the tank capacitor 201.

A voltage limiting circuit 204 is provided with a switching device 210 whose collector and emitter are connected between the output terminal of the oscillation circuit 303 and GND, resistors 211 and 212 connected in series between the positive-polarity output terminal of the DC/DC converter 203 and GND, and a Zener diode 207 connected between the connection point between the resistor 211 and the resistor 212 and the base of the switching device 210. When the voltage divided by the resistors 211 and 212 reaches the breakdown voltage of the Zener diode 207, the voltage limiting circuit 204 makes the switching device 210 turn on and makes the switching device 302 turn off so as to stop the output of the voltage boosting transformer 301 and to stop charging of the tank capacity 201, so that the voltage across the tank capacity 201 is limited.

One end of the tank capacitor 201 of the DC power source 110 is connected with one end of the resonance coil 111, and the other end thereof is connected to GND. One end of the ignition capacitor 112 is connected with the other end of the resonance coil 111. The first switch 113 is formed of an IGBT, which is a semiconductor switching device; the emitter thereof is connected with the other end of the tank capacitor 201, and the collector thereof is connected with the other end of the ignition capacitor 112. The resonance coil 111 is formed of an air-core coil having an inductance that is 100 [pH] or less more greatly than 0 [pH].

The second switch 105 is formed of an IGBT, which is a semiconductor switching device; the emitter thereof is connected with the other end of the ignition capacitor 112. The ignition coil device 102 is provided with the primary coil 102*a* and the secondary coil 102*b* that are magnetically coupled with each other by the intermediary of the iron core 102*c*; one end of the primary coil 102*a* is connected with the one end of the ignition capacitor 112, and the other end thereof is connected with the collector of the second switch 105. One end of the secondary coil 102*b* is connected with the central electrode, which is one of the electrodes of the ignition plug 101, and the other end thereof is connected to GND. The central electrode of the ignition plug 101 and the GND electrode, which is connected to GND, face each other through a predetermined gap.

When a first control signal Sc is given from the control device 103 to the base of the first switch 113, the first switch 113 turns on, and then, charge transition from the tank capacitor 201 to the ignition capacitor 112 is started; then, charging of the ignition capacitor 112 is started. In this situation, the resonance coil 111 is provided between the tank capacitor 201 and the ignition capacitor 112; therefore, due to the resonance phenomenon caused by the resonance coil 111 and the ignition capacitor 112, the ignition capacitor 112 is charged up to a voltage that is approximately twice as high as the voltage across the tank capacitor 201 in a time that is approximately a quarter of the cycle of the resonance. At this time, the second switch 105 is off; therefore, the ignition capacitor 112 and the primary coil 102*a* of the ignition coil device 102 are electrically cut off from each other. As described later, the second switch 105 turns on when a second control signal Si from the control device 103 is given to the base thereof.

Because its emitter is not earthed, the second switch 105 is so-called floating. Accordingly, in order to stably operate the second switch 105, a half bridge driving device 202, which serves as a drive circuit, is provided. That is to say, the half bridge driving device 202 is to generate a stable electric potential for driving the second switch 105; the half bridge driving device 202 is provided with an internal capacitor 205 and a first internal switch SW1 and a second internal switch SW2 that are connected with the one end and the other end, respectively, of the internal capacitor 205.

In response to the first control signal Sc or the second control signal Si from the control device 103, the first internal switch SW1 and the second internal switch SW2 configure a charging circuit or form a discharging circuit for the internal capacitor 205. That is to say, in response to the first control signal Sc, the movable contacts of the first internal switch SW1 and the second internal switch SW2 are connected with the respective lower fixed contacts in FIG. 2; thus, the charging circuit for the internal capacitor 205 is formed through the path consisting of the battery 106, the second internal switch SW2, the internal capacitor 205, the first internal switch SW1, and GND, in that order. In response to the second control signal Si, the movable contacts of the first internal switch SW1 and the second internal switch SW2 are connected with the respective upper fixed contacts in FIG. 2; thus, the discharging circuit for the internal capacitor 205 is formed through the path consisting of the internal capacitor 205, the second internal switch SW2, the base of the second switch 105, the first internal switch SW1, and the internal capacitor 205, in that order.

In addition, in FIG. 2, as the first internal switch SW1 and the second internal switch SW2, mechanical switches are illustrated; however, they may be switches formed of a semiconductor, switches configured with software, or switches configured with the combination of them, as long as they are provided with functions corresponding to the foregoing movable and fixed contacts. The energy supply device 104 and the control device 103 may be arranged in a single and the same package.

Figure 3:
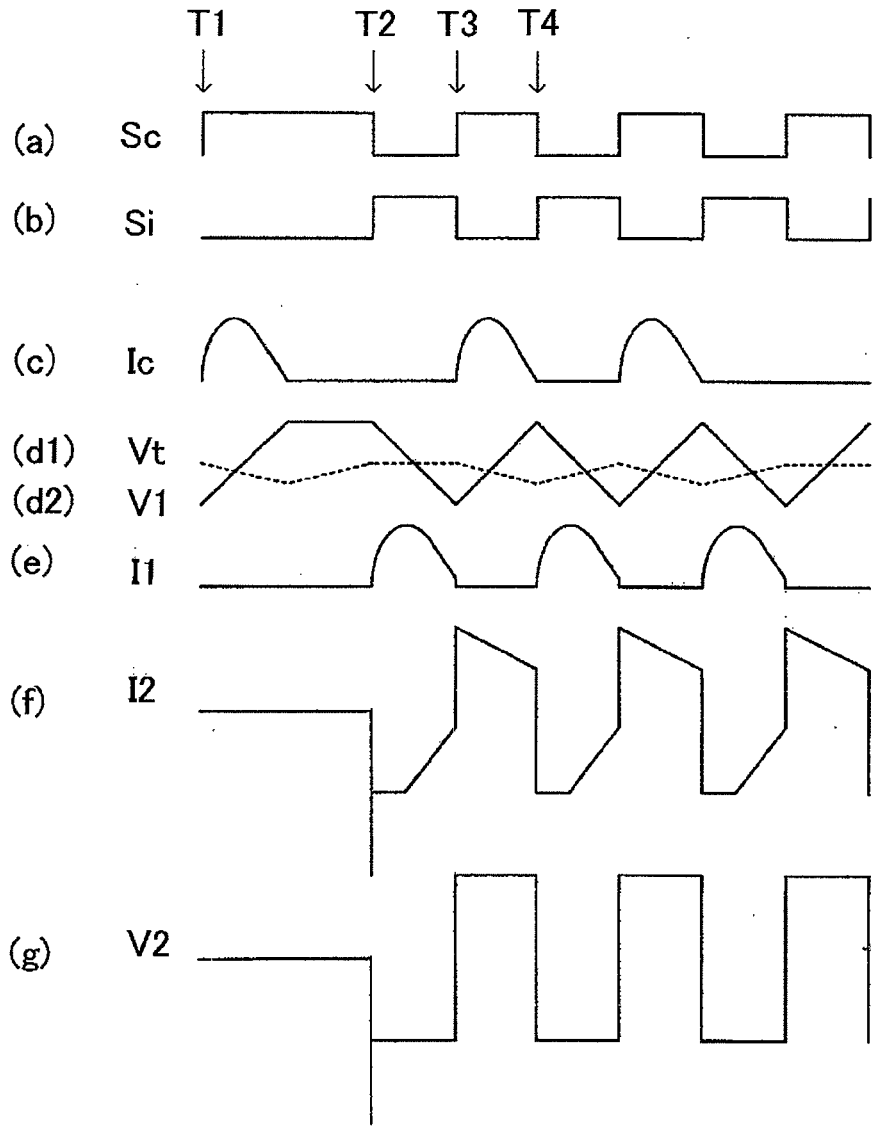
FIG. 3 is a timing chart for explaining the operation of an ignition apparatus according to Embodiment 1 of the present invention.

Next, there will be explained the operation of the ignition apparatus, according to Embodiment 1 of the present invention, that is configured as described above. FIG. 3 is a timing chart for explaining the operation of the ignition apparatus according to Embodiment 1 of the present invention and is a set of waveforms representing the respective temporal transitions of (a) the first control signal Sc, (b) the second control signal Si, (c) a charging current is for the ignition capacitor 112, (d1) an electric potential Vt of the tank capacitor 201, (d2) an electric potential V1 of the ignition capacitor 112, (e) a primary current I1 that flows in the primary coil 102*a* of the ignition coil device 102, (f) a secondary current I2 that flows in the secondary coil 102*b* of the ignition coil device 102, and (g) a secondary voltage V2, which is an induction voltage generated across the secondary coil 102*b*, i.e., a voltage that is applied to the central electrode of the ignition plug 101.

Here, the basic operation of the ignition apparatus will be explained. In FIGS. 2 and 3, when at the timing T2, the control device 103 generates the second control signal Si, the movable contacts of the first internal switch SW1 and the second internal switch SW2 of the half bridge driving device 202 are connected with the respective upper fixed contacts; electric charges on the internal capacitor 205 are discharged through the base and the emitter of the second switch 105; then, the second switch 105 turns on. As a result, the electric charges that have been stored in the ignition capacitor 112 flow to the lower-voltage side of the ignition capacitor 112 through the primary coil 102*a* of the ignition coil device 102 and the second switch 105.

The flow of electric charges from the ignition capacitor 112 to the primary coil 102*a* is the primary current I1 that flows in the primary coil 102*a*; the primary current I1 starts to flow from the timing T2, as the waveform represented in FIG. 3(*e*). The electric potential V1 of the ignition capacitor 112 gradually lowers with time from the timing T2, as represented in FIG. 3(*d*2). When the primary current I1 flows in the primary coil 102*a*, an induction electromotive force is generated across the secondary coil 102*b* that is magnetically coupled with the primary coil 102*a*, as represented in FIG. 3(*g*). Because the one end of the secondary coil 102*b* is connected with the central electrode of the ignition plug 101, the induction electromotive force generated across the secondary coil 102*b* is transferred to the central electrode of the ignition plug 101.

Concurrently, when the primary current I1 flows in the primary coil 102*a*, the iron core 102*c* of the ignition coil device 102 is magnetized, i.e., magnetic energy is stored. When as described later, the flow of the primary current I1 flowing in the primary coil 102*a* is cut off at the timing T3, the release of the magnetic energy stored in the iron core 102*c* starts; an induction electromotive force, having a direction opposite to the direction of the induction electromotive force that is generated when the primary current I1 flows, is generated across the secondary coil 102*b*; then, this induction electromotive force is also transferred to the central electrode of the ignition plug 101.

By, as described above, repeating the energization and the cutoff of the primary current I1 that flows in the primary coil 102*a*, induction electromotive forces, the directions of which are opposite to each other, are generated across the secondary coil 102*b*, as represented in FIG. 3(*g*); this AC voltage is applied to the central electrode of the ignition plug 101. Accordingly, an AC magnetic field is generated between the electrodes of the ignition plug 101. Heretofore, the basic operation of the ignition apparatus has been explained.

Next, dividing the point of view into the point of view of the energy supply device 104 and the point of view of the ignition coil device 102, there will be explained, with reference to FIGS. 2 and 3, the operation of the ignition apparatus according to Embodiment 1 of the present invention and the method of selecting parameters, described later, for producing plasma (referred to as volume plasma, hereinafter), between the electrodes of the ignition plug 101, that has a large cross section and a wide spread, compared to plasma produced in ordinary cases.

Firstly, in view of the energy supply device 104, the generation of the volume plasma will be explained. As described above, the energy supply device 104 is configured with the DC power source 110, the resonance coil 111, the ignition capacitor 112, and the first switch 113. Here, the conditions required for generating the volume plasma are that the amount of fluctuation per unit time in the AC magnetic field between the electrodes of the ignition plug 101 is large and that long-life plasma can be generated. The foregoing two conditions can be paraphrased by the expressions that compared to the normal time, the frequency for providing the AC magnetic field is high and that the discharge current is large.

The preliminary operation prior to the generation of the discharge plasma is started from the timing T1 represented in FIG. 3. In other words, as represented in FIGS. 3(*a*) and 3(*b*), at the timing T1, the control device 103 switches the level of the first control signal Sc to a high level (referred to as H level, hereinafter) and the level of the second control signal Si to a low level (referred to as L level, hereinafter). When the level of the first control signal Sc becomes H level, the first switch 113 turns on; the charging current Ic represented in FIG. 3(*c*) flows from the tank capacitor 201 to the ignition capacitor 112, by way of the resonance coil 111; then, the ignition capacitor 112 is charged.

In this situation, at an initial time of ignition operation, i.e., when the ignition apparatus is activated, the internal capacitor 205 of the half bridge driving device 202 has not been charged, or the charging amount has been reduced; therefore, because no stable electric potential for driving the second switch 105 cannot be supplied, it is required to charge the internal capacitor 205 up to a predetermined electric potential. Accordingly, the H-level period (T1 to T2), of the first control signal Sc, that corresponds to the initial charging period for the internal capacitor 205 is made longer than any one of the charging periods after and including the second H-level period (T3 to T4) so that the internal capacitor 205 is charged to the predetermined electric potential. For example, the period from the timing T1 to the timing T2 is set to approximately 3 [ms].

Then, when the level of the first control signal Sc is switched to H level at the timing T1, the movable contacts of the first internal switch SW1 and the second internal switch SW2 of the half bridge driving device 202 are connected with the respective lower fixed contacts, so that the battery 106 charges the internal capacitor 205 up to the predetermined electric potential in the period from the timing T1 to the timing T2.

The discharge between the electrodes of the ignition plug 101 starts the generation of volume plasma in such a manner as described below. That is to say, when at the timing T2, the first control signal Sc and the second control signal Si are switched to L level and H level, respectively, the first switch 113 turns off and the second switch 105 turns on, so that the charges on the ignition capacitor 112 that has been charged in the period from the timing T1 to the timing T2 flow to the primary coil 102*a* of the ignition coil device 102. The flow of the charges is the primary current I1 represented in FIG. 3(*e*). When the primary current I1 flows in the primary coil 102*a*, the accumulation of magnetic energy in the iron core 102*c* of the ignition coil device 102 is started; concurrently, the negative-polarity induction voltage V2 represented in FIG. 3(*g*) is generated across the secondary coil 102*b*.

The induction voltage V2 generated across the secondary coil 102*b* is transferred to the central electrode of the ignition plug 101; then, when a dielectric breakdown (referred to also as a flashover) is produced between the central electrode and the GND electrode, the negative-polarity secondary current I2 starts to flow. The negative-polarity secondary current I2 flows in the period from the timing T2 to the timing T3. In this situation, the period from the timing T2 to the timing T3, in which negative-polarity secondary current I2 flows, is set in such a way that the magnetic energy is stored as much as possible in the ignition coil device 102 and the foregoing period becomes as short as possible, so that the operational efficiency can be raised. Thus, the timing immediately before the flow of the primary current I1 stops is made to coincide with the timing T3. For example, the period from the timing T2 to the timing T3 is set in such a way as to be approximately 20 [μsec]. In this regard, however, the period from the timing T2 to the timing T3 is a value determined in accordance with the characteristics of the ignition coil device 102 to be connected and hence is adjusted in accordance with the characteristics of the ignition coil device 102.

Next, at the timing T3, the levels of the first control signal Sc and the second control signal Si are switched to H level and L level, respectively. As a result, the first switch 113 turns on and the second switch 105 turns off; the primary current I1 that has been flowing in the primary coil 102*a* is cut off; then, release of the magnetic energy that has been accumulated in the iron core 102*c* of the ignition coil device 102 begins. In this case, contrary to the period (T2 to T3), the positive-polarity induction voltage V2 is generated across the secondary coil 102*b*, as represented in FIG. 3(*g*); then, as represented in FIG. 3(*f*), the secondary current I2 starts to flow between the electrodes of the ignition plug 101.

It is desirable that as is the case with the period from the timing T2 to the timing T3, the period from the timing T3 to the timing T4 is set to be as short as possible; however, because the ignition capacitor 112 is charged in the period from the timing T3 to the timing T4, the efficiency becomes best when the period from the timing T3 to the timing T4 is set in such a way as to coincide with a time corresponding to the charging time for the ignition capacitor 112; for example, the period from the timing T3 to the timing T4 is set in such a way as to be approximately 20 [μsec]. In this case, the capacitances of the tank capacitor 201 and the ignition capacitor 112 may be approximately 100 [μF] and 2 [μF], respectively.

Heretofore, there has been explained a case where after the timing T2, the L-level period of the first control signal Sc (the H-level period of the second control signal Si) and the H-level period of the first control signal Sc (the L-level period of the second control signal Si) are set in such a way as to be is equal to each other, for example, the respective periods are set to be 20 [μsec]; however, it is not required to make the periods equal to each other. As described above, it is desirable that these periods are as short as possible. However, the shorter these periods are, the more difficult it is to obtain the peak of the secondary current I2; thus, these periods should be optimized in accordance with the environment where the ignition apparatus is utilized. Lengthening these periods does not pose any problem for the apparatus configuration, but makes it more difficult to produce volume plasma; from the study continued so far, it is conceivable that the practical range of each period is from 5 [μsec] to 50 [μsec].

It is conceivable that volume plasma is a phenomenon in which by producing new plasma before produced present plasma disappears, it looks that the total amount of plasma increases; however, the existing duration of plasma relates to the current level of a discharge between the electrodes, i.e., the amount of energy supplied to the plasma. The result of the experiment by the inventor and the like confirmed that in the case where the ignition apparatus according to Embodiment 1 is configured, when after the timing T2, the L-level period of the first control signal Sc (the H-level period of the second control signal Si) and the H-level period of the first control signal Sc (the L-level period of the second control signal Si) are each set in a range from approximately 5 [μsec] to approximately 50 [μsec], plasma can continue to exist.

Accordingly, the first control signal Sc and the second control signal Si from the control device 103 are alternately and continually outputted for the purpose of switching the first switch 113 and the second switch 105 in a cycle of 5 [μsec] to approximately 50 [μsec], so that volume plasma can be produced between the electrodes of the ignition plug.

Theoretically, the minimum value of the foregoing switching period may be set to be further smaller, and may be set to an optimum value by taking into consideration impedance matching determined by the length of the wiring lead in a vehicle; thus, the minimum value is not limited to 5 [μsec]. Accordingly, theoretically, the interval of the switching between the first switch 113 and the second switch 105 may be 5 [μsec] to 50 [μsec].

Next, in view of the ignition coil device 102, there will be explained, with reference to FIGS. 2 and 3, the operation of the ignition apparatus according to Embodiment 1 of the present invention and the method of selecting parameters for producing volume plasma between the electrodes of the ignition plug 101.

It is a basic idea that volume plasma is produced in such a way that plasma is produced between the electrodes of the ignition plug 101, and, according to Embodiment 1 of the present invention, an AC magnetic field generated by the secondary current I2 is applied to the produced plasma so that the plasma is increased. Accordingly, it is desirable that the plasma between the electrodes of the ignition plug 101, produced by the secondary current I2, is high-energy plasma that can maintain its existence by the time it is swung (oscillates) by the AC magnetic field or while it is swung. In other words, the coil that can accumulate magnetic energy in a short time and is characterized by being capable of outputting a large secondary current I2 is a coil suitable for an ignition apparatus according to Embodiment 1 of the present invention.

Accordingly, for example, the primary current I1 and the secondary current I2 are increased by thickening the wire diameter of the coil of the ignition coil device 102 and decreasing the resistance value of the coil; for the purpose of storing a great deal of magnetic energy by use of a small primary current I1, the number of turns of the primary coil 102*a* is increased; or, the secondary current I2 is increased by decreasing the number of turns of the secondary coil 102*b*, thereby reducing the resistance value of the coil. Alternatively, the cross-sectional area of the iron core 102*c* is reduced so that the magnetic energy can rapidly be accumulated or released. Such a configuration of the ignition coil device 102 makes it possible to obtain an ignition coil, the discharging time of which is 50 [μsec], as described above, and the peak value of the secondary current I2 of which is the same as or larger than 200 [mA]; thus, there can be obtained the ignition coil device 102 suitable for an ignition apparatus according to Embodiment 1 of the present invention.

The cycle of the AC magnetic field generated through the combination of these parts becomes the same as or higher than 10 [kHz], whereby the problem of impedance matching or the like is not posed or almost negligible. In addition, only the ignition plug is provided in the combustion chamber of an internal combustion engine, and it is not required to provide a device such as an antenna; therefore, volume plasma can be produced through a simple configuration.

Because the operation after the timing T4 is the repetition of the operation during the period from the timing T2 to the timing T4, detailed explanation therefor will be omitted; as described above, by repeatedly applying an AC magnetic field to discharge plasma, volume plasma can be produced.

An ignition apparatus according to the present invention is mounted in an automobile, a motorcycle, an outboard engine, an extra machine, or the like utilizing an internal combustion engine, and is capable of securely igniting an inflammable fuel-air mixture; therefore, the ignition apparatus makes it possible to effectively operate the internal combustion engine, and hence contributes to the environment preservation and to the solution of the problem of inflammable fuel-air mixture depletion.

Various modifications and alterations of this invention will be apparent to those skilled in the art without departing from the scope and spirit of this invention, and it should be understood that this is not limited to the illustrative embodiments set forth herein.

What is claimed is:

1. An ignition apparatus comprising:

an ignition plug that is provided with a pair of electrodes that face each other through a gap and that produces a spark discharge in the gap when a predetermined high voltage is applied across the pair of electrodes so that an inflammable fuel-air mixture inside a combustion chamber of an internal combustion engine is ignited;

an ignition coil device that generates the predetermined high voltage, by accumulating energy and releasing the accumulated energy, and that applies the generated predetermined high voltage across the electrodes;

an energy supply device that is provided with an ignition capacitor to be charged through a resonance coil by a DC power source and a first switch connected between the ignition capacitor and a ground potential, and that can supply the energy to the ignition coil device from the ignition capacitor;

a second switch connected between the ignition coil device and the energy supply device; and a control device that outputs a first control signal for controlling switching operation by the first switch and a second control signal for controlling switching operation by the second switch, wherein the first control signal controls a time instant when the first switch is turned from off to on and a time during which the first switch is kept on; the second control signal controls a time instant when the second switch is turned from off to on and a time during which the second switch is kept on; the first control signal and the second control signal control respective switching operations of the corresponding switches in such a way that when the first switch is on, the second switch becomes off, and when the first switch is off, the second switch becomes on; when the first switch is on, the energy supply device charges the ignition capacitor to a voltage value whose absolute value is larger than an output voltage value of the DC power source, through resonance caused by the resonance coil and the ignition capacitor; and when the second switch is on, the ignition coil device receives the energy from the charged ignition capacitor and accumulates the energy, and when the second switch is off, the ignition coil device releases the accumulated energy so as to generate the high voltage.

2. The ignition apparatus according to claim 1, wherein the time during which the first switch is kept on and the time during which the second switch is kept on are each between 0 [μsec] and 50 [μsec].

3. The ignition apparatus according to claim 1, further including a drive circuit that generates an internal voltage in synchronization with switching operation by the first switch, wherein the second switch performs switching operation in response to the internal voltage, generated by the driving circuit, that is supplied to the second switch or is cut off based on the second control signal.

4. The ignition apparatus according to claim 1, wherein the control device controls the first switch in such a way that the time during which the first switch is kept on at an activation timing is longer than the time during which the first switch is kept on thereafter.

5. The ignition apparatus according to claim 1, wherein the resonance coil is formed of an air-core coil having an inductance that is between 0 [μH] and 100 [μH].

6. The ignition apparatus according to claim 1, wherein the ignition coil device is characterized by producing the spark discharge between the electrodes of the ignition plug for a time that is between 0 [μsec] and 50 [μsec].

7. The ignition apparatus according to claim 1, wherein the energy supply device and the control device are arranged in the same package.

* * * * *